United States Patent [19]

Wong et al.

[11] Patent Number: 5,006,859

[45] Date of Patent: Apr. 9, 1991

[54] PATCH ANTENNA WITH POLARIZATION UNIFORMITY CONTROL

[75] Inventors: Mon N. Wong, Torrance; Robert J. Patin, Hawthorne; Brennan J. Trese, Los Angeles; Krishnan K. Raghavan, Redondo Beach, all of Calif.

[73] Assignee: Hughes Aircraft Company, Los Angeles, Calif.

[21] Appl. No.: 500,332

[22] Filed: Mar. 28, 1990

[51] Int. Cl.[5] ..... H01Q 1/38

[52] U.S. Cl. ..... 343/700 MS; 343/830

[58] Field of Search ..... 343/700 MS, 830, 749, 343/834

[56] References Cited

U.S. PATENT DOCUMENTS

| | | | |
|---|---|---|---|
| 4,242,685 | 12/1980 | Sanford | 343/700 MS |
| 4,260,988 | 4/1981 | Yanagisawa et al. | 343/700 MS |
| 4,347,517 | 8/1982 | Kaloi | 343/700 MS |
| 4,605,933 | 8/1986 | Butscher | 343/700 MS |
| 4,791,423 | 12/1988 | Yokoyama et al. | 343/700 MS |
| 4,827,266 | 5/1989 | Sato et al. | 343/700 MS |
| 4,835,539 | 5/1989 | Paschen | 343/700 MS |

*Primary Examiner*—Michael C. Wimer

*Assistant Examiner*—Hoanganh Le

*Attorney, Agent, or Firm*—Robert A. Westerlund; Steven M. Mitchell; Wanda K. Denson-Low

[57] ABSTRACT

A patch antenna is formed of one or more flat disc-shaped radiators disposed parallel to and spaced apart from a common ground-plane element. At each radiator, there is a feed assembly of two feeds positioned to one side of a center of the radiator in space quadrature and excited in phase quadrature for generating circularly polarized radiation from the radiator. Each of the feeds, in a preferred embodiment of the invention, is formed as a post extending through an aperture in the ground-plane element partway to the radiator for capacitive coupling with the radiator. At each radiator, a reactance element on the form of a capacitive block extends from the ground-plane element partway to the radiator at a location diametrically opposite the feed assembly. Capacitive reactance of the reactance element is approximately one order of magnitude less than the sum of the capacitive reactance of the two feeds at each radiator to reduce mutual coupling between the feeds of each radiator to counteract any elliptical polarization to produce accurately a circular polarization.

11 Claims, 2 Drawing Sheets

PATCH ANTENNA WITH POLARIZATION UNIFORMITY CONTROL

BACKGROUND OF THE INVENTION

This invention relates to electromagnetic patch antennas excited by dual feeds for generation of circularly polarized radiation and, more particularly, to the inclusion of a capacitive block between radiator and ground plane to balance asymmetry in locations of the feeds to introduce uniformity to the circularly polarized radiation.

Patch antennas may be constructed individually or in arrays of patch radiators operating with a common ground plane for transmitting and receiving beams of electromagnetic radiation in a wide variety of situations including communication and radar. A patch antenna is suitable for use both in fixed and mobile installations. The light weight of a patch antenna enhances the suitability of the antenna for use in the construction of an antenna system to be carried by a satellite encircling the earth.

In the usual construction of a patch antenna, one or more disc-shaped radiators are positioned in front of a ground-plane element, and spaced apart from the ground-plane element to permit radiation from the radiators. By way of example, the radiators and the ground-plane element may be formed of electrically-conductive sheets such as thin layers of brass, copper, aluminum or other electrically conductive material, and the sheets may be spaced apart by a layer of dielectric material. While patch antennas may be employed for the generation of radiation with linear, circular or elliptical polarization, the generation of circularly polarized radiation is of particular interest herein. Circularly polarized radiation is obtained frequently by the use of two electromagnetic feeds located on a ground-plane element beneath a radiator, and located ninety degrees apart around a central axis of a radiator in a space-quadrature relationship. The two feeds are excited with signals having sinusoidal waveforms which are ninety degrees out of phase, this being phase quadrature. Two well-known forms of feed are slots located in the ground plane element and extending both beneath and slightly beyond the radiator, and posts which pass through apertures in the ground-plane element to extend partway to the radiator.

A problem arises in the foregoing arrangement of feeds. It is noted that each of the feeds is excited independently of the other, and that the resulting circular polarization of emitted radiation results from a summation of two linearly polarized waves excited by respective ones of the feeds. Since the two feeds are located off to one side of the center of the radiator, the spacing between the feeds is sufficiently close to induce mutual coupling between the feeds. As a result of the mutual coupling, the circularly polarized radiation, which ideally has transverse components of equal magnitude, becomes slightly elliptical. As a result, the intensity of radiation varies with direction about a central axis of the radiator. This variation may introduce excessive signal loss, particularly in the case of reception of weak signals.

In the foregoing description, and in the ensuing description of the patch antennas, reference is made to the transmission of radiation. However, it is to be understood that the patch antennas discussed herein operate in reciprocal fashion such that the radiation characteristics are the same for both transmission and reception.

SUMMARY OF THE INVENTION

The aforementioned problem is overcome and other advantages are provided by the present invention, which encompasses a patch antenna which may include one or more radiators disposed in front of one or more ground-plane elements. To facilitate advantageous construction of the antenna, it is preferred that a single ground-plane element be employed The invention is employed with a patch radiator excited by a pair of feeds operating in both space quadrature and phase quadrature to provide circularly polarized radiation. The invention introduces uniformity to the circularly polarized radiation to ensure essentially equal intensity in different directions about a central axis of a radiator.

The uniformity is obtained, in the case of feeds constructed as capacitive posts, by the introduction of a capacitive reactance element between the ground-plane element and the radiator, the capacitive reactance component being located on a side of the radiator opposite the locations of the two feeds. The capacitive reactance element is equidistant from the two feeds. In a preferred embodiment of the invention, the capacitive reactance element is constructed of a block of electrically conductive material upstanding from a front surface of the ground-plane element and extending partway to the bottom surface of the radiator. Since the posts of the feeds each introduce capacitive reactance to the antenna structure with a consequent mutual coupling between the feeds, the reactance introduced by the additional reactance element tends to induce additional coupling with a generation of electric fields which partially cancel the electric fields of the mutual coupling between the feeds, so as to produce more accurate and uniform circularly polarized radiation.

BRIEF DESCRIPTION OF THE DRAWING

The aforementioned aspects and other features of the invention are explained in the following description, taken in connection with the accompanying drawing wherein.

DETAILED DESCRIPTION

Figure 1:
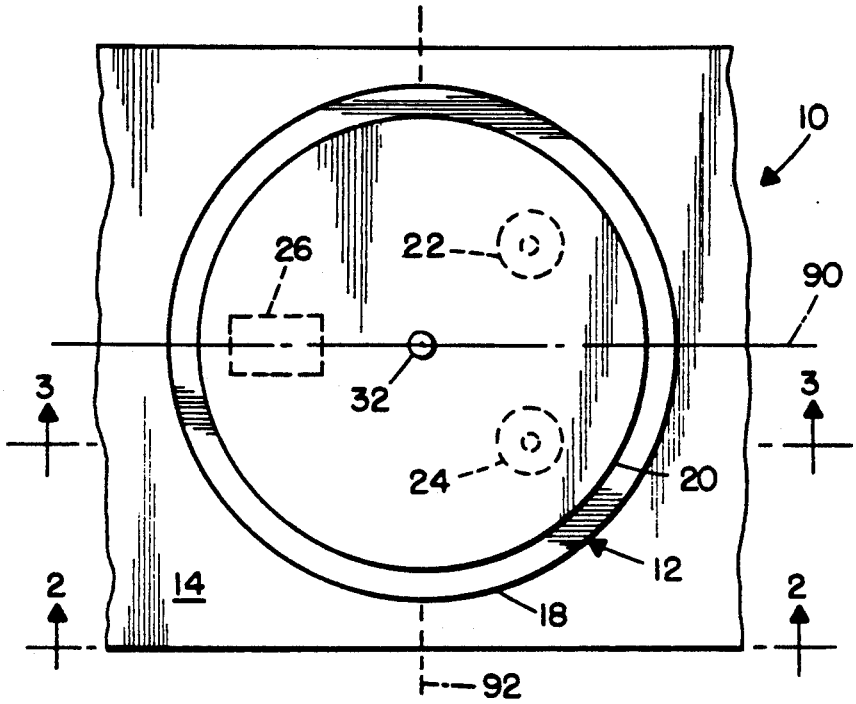
FIG. 1 is a top plan view of a patch antenna including a capacitive reactance block in accordance with the invention, the block and the feeds being shown in phantom, the view applying to various embodiments of the invention, the figure showing one radiator of an antenna which may comprise a plurality of radiators.
Figure 2:
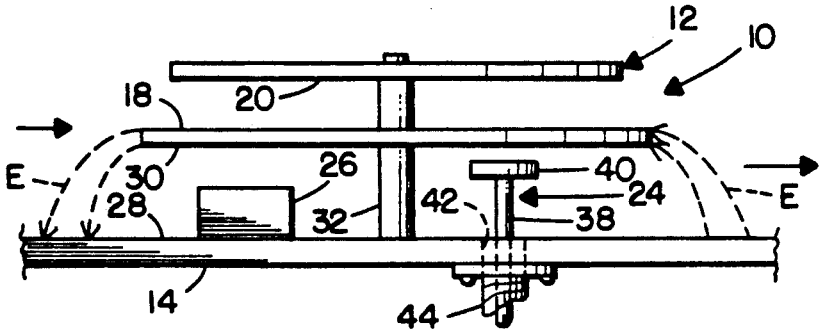
FIG. 2 is a side elevation view of the antenna of FIG. 1, FIG. 2 showing a radiator composed of a driven element and a parasitic element spaced apart from a ground-plane element, a coaxial connector being employed to couple microwave power to each of the feeds.

With reference to FIGS. 1 and 2, there is shown a single element of a patch antenna 10, the antenna element comprising a radiator 12 supported above a ground-plane element 14 for radiating circularly polarized radiation directed radially outward of a central axis 16 (FIG. 3) of the radiator 12. The radiator 12 includes a driven element 18 and a parasitic element 20, the driven element 18 being positioned between the parasitic element 20 and the ground-plane element 14. Two feeds 22 and 24 extend upward from the ground-plane element 14 toward the driven element 18 for exciting the radiator 12 to transmit circularly polarized radiation. The antenna 10 operates in reciprocal fashion during reception wherein the feeds 22 and 24 cooperate with the radiator 12 to receive circularly polarized radiation.

Figure 3:
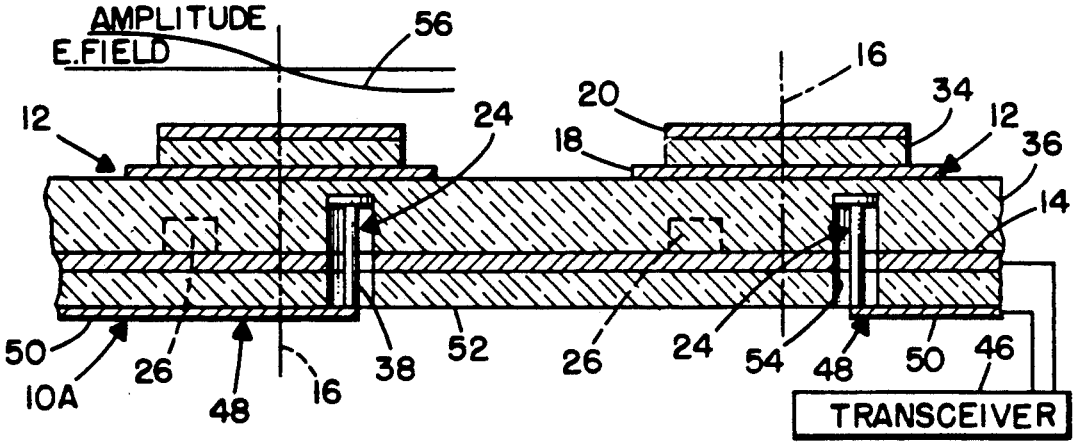
FIG. 3 is a sectional view of the antenna of FIG. 1 in accordance with a second embodiment of the invention wherein the elements of the antenna are spaced apart by layers of dielectric material, connection of microwave power from a transceiver being made by microstrip transmission line to the feeds of a radiator, the view of FIG. 3 being taken along the line 3—3 in FIG. 1 and portraying, by way of example, two radiators of an array of radiators.

In accordance with the invention, the antenna element further comprises a reactive element in the form of a block 26 which is located on the top surface 28 of the ground-plane element 14 and extends upward partway towards the bottom surface 30 of the driven element 18. The parasitic element 20, the driven element 18, and the ground-plane element 14 are constructed of electrically conducting material, preferably a metal such as brass or aluminum. The block 26 is fabricated of the same material as the ground-plane element 14, and may be secured to the ground-plane element 14 by conventional methods such as by brazing. In the embodiment of FIG. 2, the parasitic element 20, the driven element 18, and the ground-plane element 14 each have a planar shape and are held parallel to each other and spaced apart from each other by a rod 32. In the embodiment of FIG. 3, the parasitic element 20, the driven element 18 and the ground-plane element 14 are held in their respective positions by layers 34 and 36 of dielectric material, the layer 34 being located between and contiguous the parasitic element 20 and the driven element 18, and the layer 36 being located between and contiguous the driven element 18 and the ground-plane element 14.

The feeds 22 and 24 have the same construction. As shown in FIG. 2, the feed 24 is formed as a post 38 with a cap 40 at the top end of the post 38. The bottom portion of the post 38 passes through an aperture 42 in the ground-plane element 14 to become the center conductor of a coaxial connector 44 secured to the bottom surface of the ground-plane element 14. The post 38 is electrically insulated from the ground-plane element 14 so as to allow for signals propagating in a coaxial transmission line via the connector 44 to be impressed upon the feed 24.

In FIG. 3, an antenna 10A is constructed as an embodiment of the invention which is an alternative to the embodiment of the antenna 10 of FIG. 1. In FIG. 3, the antenna 10A includes the parasitic element 20, the driven element 18, and the ground-plane element 14 which, as noted above, are positioned relative to each other by means of the dielectric layers 34 and 36 rather than by means of the rod 32. Also included in the embodiment of FIG. 3 are the feeds 22 and 24 (only the feed 24 being visible in the view of FIG. 3), and the block 26. Coupling of the feeds 22 and 24 to an external signal source or receiver, such as a transceiver 46, is provided by means of a microstrip transmission line 48. The transmission line 48 is formed of a strip conductor 50 secured to the bottom side of the ground-plane element 14 by a layer 52 of dielectric material disposed between the conductor 50 and the ground-plane element 14. The dielectric layer 52 maintains the strip conductor 50 parallel to and spaced apart by a predetermined distance from the ground-plane element 14. Both of the antenna elements of the antenna 10A are of the same construction, and include the radiator 12, the block 26, the feeds 22 and 24, and the microstrip transmission lines 48. The post 38 of the feed 24, as well as of the feed 22 (not shown in FIG. 3) are each disposed each within an aperture 54 in the layer 52, the aperture 54 extending as a channel through the ground-plane element 14 and the layer 36 to enable electrical connection between the post 38 and the strip conductor 50 of the microstrip line 48. The dielectric layers 34, 36, and 52 may be fabricated of a material such as fiberglass embedded in epoxy or similar electrically insulating material such as a dielectric board material sold under the trademark DUROID.

In general, each of the elements of the radiator 12 in either of the antennas 10 and 10A are circular and have diameters approximately equal to one-half wavelength of the radiation transmitted by the radiator 12. The parasitic element 20 is slightly smaller than the driven element 18 by an amount approximately ten to twenty percent of the diameter of the driven element 18. By way of example, in the construction of a patch antenna to radiate at L-band, the diameter of the driven component 18 is 3.9 inches while the diameter of the parasitic element 20 is 3.4 inches. The spacing on centers between radiators 12 in an array of radiators, such as the two radiators of FIG. 3, is 5.9 inches in a preferred embodiment of the invention operating at L-band wherein the wavelength of the radiation is 7.4 inches. The same form of construction, but scaled in accordance with the wavelength of the radiation, can be used by way of example at S-band and C-band. The half-wavelength diameter of the radiator 12 provides for an electric field distribution in which the amplitude varies essentially sinusoidally about the perimeters of the radiator elements 18 and 20 with a null at a plane passing through the axis 16 as shown in a graph 56 appended to the left radiator 12 in FIG. 3. The null at the axial plane occurs in both of the embodiments of FIGS. 2 and 3. Accordingly, the rod 32 of FIG. 2 can be fabricated of electrically insulating material or electrically conductive material since the electric field is zero at an axial plane. Nonzero values are indicated in FIG. 2 by electric field lines, E, interconnecting the driven element 18 and the ground-plane element 14 on FIG. 2.

Figure 4:
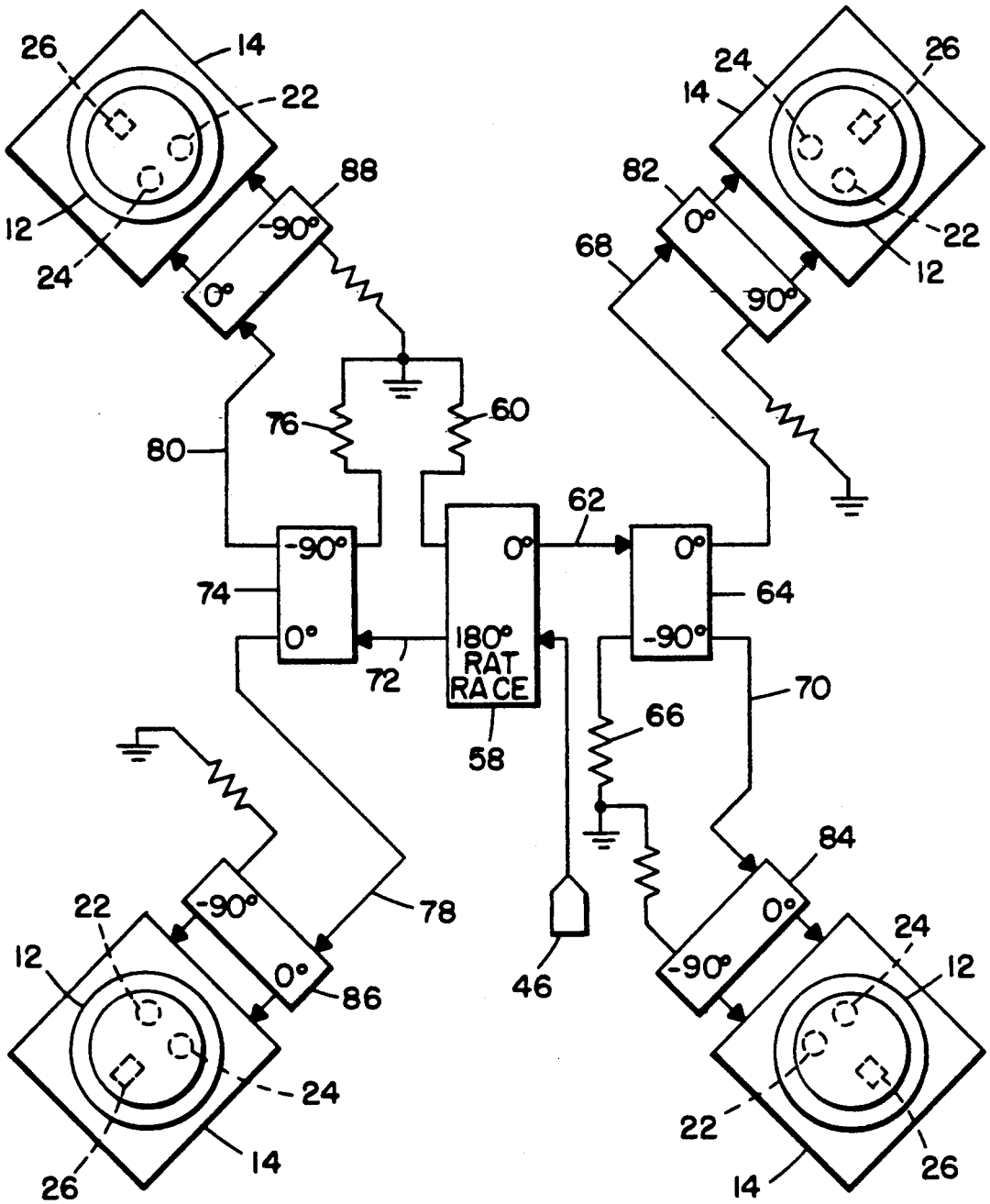
FIG. 4 is a diagrammatic view of a patch antenna composed of a set of four radiators arranged in a square, the radiators being rotated ninety degrees successively relative to each other for improved cancellation of any ellipticity in a pattern of radiation generated by the array of radiators, FIG. 4 also showing microwave circuitry for applying the signal of a transmitter to the feeds of the various antenna elements in phase quadrature.

FIG. 4 shows a method of interconnecting the transceiver 46 with an antenna comprising an array of four radiators 12 arranged in a square array upon ground-plane elements 14. Preferably, the ground-plan elements 14 are joined together as a single ground-plane element in which case the view of FIG. 3 can be considered to be a sectional view also of the antenna of FIG. 4. In order to provide circularly polarized radiation, the feeds 22 and 24 are fed in phase quadrature by applying sinusoidal signals of equal frequency to the two feeds 22 and 24 at each radiator 12, the two signals differing in phase by ninety degrees. This is accomplished by the circuitry of FIG. 4. An output signal of the transceiver 46 is coupled to an input port of a rat-race coupler 58. One terminal of the coupler 58 is grounded via a terminating resistor 60. The remaining two terminals provide output signals, one of which is in phase with the signal of the transceiver 46, and the other of which is 180 degrees out of phase with the signal of the transducer 46. The in-phase signal is coupled via line 62 to a hybrid coupler 64 of which one terminal is grounded via a terminating resistor 66 and the remaining two terminals output signals on lines 68 and 70. The signal on line 68 is in phase with the signal on line 62, and the signal on line 70 lags the signal on line 62 by ninety degrees. At the rat-race coupler 58, the out-of-phase signal is coupled via line 72 to a hybrid coupler 74 of which one terminal is grounded via a terminating resistor 76, and the remaining two terminals output signals on lines 78 and 80. The signal on line 78 is in phase with the signal on line 72, and the signal on line 80 lags the signal on line 72 by ninety degrees.

The signals outputted on lines 68, 70, 78, and 80 are applied respectively to hybrid couplers 82, 84, 86, and 88. The hybrid couplers 82, 84, 86, and 88 function in the same manner as do the couplers 64 and 74. In each of the couplers 82, 84, 86, and 88, one terminal is grounded via a terminating resistor, and the remaining two terminals apply in-phase and quadrature signals to the feeds 24 and 22 located at respective ones of the four radiators 22. The quadrature signal, in each case is applied to the feed 22 and lags the in-phase signal by ninety degrees, the latter signal being applied to the feed 24.

By tracing the phase shifts of the various signals from the rat-race coupler 58 to the radiators 12, it is noted that the resultant electric field vector produced at each of the radiators 12 lags the electric field of the preceding radiator by ninety degrees. However, each of the antenna elements is rotated ninety degrees with respect to the preceding antenna element, with progression around the array, to counteract the foregoing increments in phase shift. This results in a common direction of polarization of the electromagnetic field radiated from all of the radiators 12. Thereby, the square array of radiators 22 produces a beam of circularly polarized radiation wherein deviations from perfect circular polarization, due to individual ellipticities of the respective antenna elements are substantially canceled by the different orientations of the individual antenna elements. This enhances the uniformity of the circular polarization.

In accordance with the invention, the uniformity of the circular polarization is enhanced still further by significantly reducing any ellipticity in the radiation pattern of any one antenna element such as that shown in FIGS. 2 or 3. This is accomplished as follows. There is capacitance between the caps 40 of the feeds 22 and 24 and the bottom surface 30 of the driven element 18. There is also capacitance between the block 26 and the bottom surface 30 of the driven element 18. With reference to FIG. 1, longitudinal and transverse axes 90 and 92, respectively, are provided for reference. Both of these axes intersect at the rod 32. The longitudinal axis 90 bisects the distance between the feeds 22 and 24 and passes through the center of the block 26. The feeds 22 and 24 are located to the right side of the transverse axis 92, and the block 26 is located to the left side of the transverse axis 92. It is to be understood herein that the terms "top", "bottom", "right", and "left" are used to facilitate reference to the drawing figures, and are not intended to imply a preferred orientation to the antenna 10 or 10A which may have any desired orientation including right-side up and up-side down.

The location of the feeds 22 and 24 to the right side of the transverse axis 92 introduces ellipticity to the circularly polarized radiation by virtue of a mutual coupling of signals of the feeds 22 and 24 through the capacitive reactances of the feeds 22 and 24 with the the driven element 18. While probes or feeds may introduce inductive or capacitive reactance or both forms of reactance, depending on the physical structure of the feed, the reactance of the feeds 22 and 24 is primarily capacitive. By introducing a relatively small compensating reactance at the location of the block 26, the ellipticity to the circular polarization is significantly reduced. The compensating reactance is capacitive and has a value equal approximately to one-tenth of the sum of the capacitive reactances of the feeds 22 and 24. Insofar as the compensation is understood, it appears that the orientation of an electric field of a signal propagating directly between the feeds 22 and 24 differs sufficiently from the orientation of an electric field of a signal propagating from a feed 22 or 24 to the block 26 so as to introduce significant cancellation and reduction of the mutual coupling between the feeds 22 and 24. This reduces the ellipticity for the enhanced circular polarization. The positioning of the block 26 on the opposite side of the radiator 12 from the feeds 22 and 24 is significant for developing the foregoing orientation of canceling electric fields because, as has been verified experimentally, a positioning of the block 26 between the feeds 22 and 24 increases the mutual coupling between the feeds 22 and 24 with resultant degradation of the circular polarization.

The following dimensions are used in constructing a preferred embodiment of the invention in accordance with the antenna 10 of FIG. 2. The cap 40 of each of the feeds 22 and 24 has the shape of a circular disc with a diameter of 500 mils. The top surface of the cap 40 is spaced apart from the bottom surface of the driven element 18 by a spacing of 24 mils. The bottom surface 30 of the driven element 28 is spaced apart from the top surface 28 of the ground-plane element 14 by a spacing of 400 mils. The spacing between the top and bottom surfaces respectively of the driven element 18 and the parasitic element 20 is 250 mils. The block 26 has a height of 250 mils, the top surface of the block 26 being spaced apart from the bottom surface of the driven element 18 by a spacing of 150 mils. In plan view, as viewed in FIG. 1, the longitudinal sides of the block 26 each have a length of 650 mils, and the transverse sides of the block 26 each have a length of 450 mils. The theory of the invention applies to patch antenna elements constructed with a radiator comprising only the driven element 18 or comprising both the driven element 18 and the parasitic element 20. The parasitic element 20 is employed in the preferred embodiment of the invention to increase the bandwidth of radiation transmitted and received by the radiator 12.

The patch antenna, as described above, has a transmission bandwidth of 1.53 GHz (gigahertz) to 1.56 GHz. The receive band extends from 1.63 GHz to 1.66 GHz. The return loss as measured by standing wave ratio is less than 1.3 on transmission and less than 2.0 on receive. There is a low axial ratio of circularly polarized radiation as measured along the longitudinal and transverse axes 90 and 92 of FIG. 1, the axial ratio being less than 0.5 dB (decibels) on transmit and less than 2.0 dB on receive. The radial positions of the feeds 22 and 24 are adjusted to obtain the best value of input impedance match to the transceiver 46, to thereby maximize transmission and reception of signal power. In the preferred embodiment of the invention, feeds 22 and 24 are each located approximately halfway between the center of the driven element 18 and the outer periphery of the driven element 18. With respect to the block 26 in the embodiment of FIG. 2, the transverse side of the block 26 facing the rod 32 is spaced apart from the rod 32 with a spacing of 850 mils. The precise location of the block 26 for best cancellation of ellipticity is determined empirically. However, good cancellation of ellipticity can be obtained with the center of the block 26 located at a radial distance from the rod 32 approximately equal to, or slightly larger, approximately three percent larger, than the spacing of either of the feeds 22 and 24 from the rod 32. The capacitive reactance of the block 26 can be enlarged by increasing the area of the top surface, as viewed in FIG. 1, and/or by decreasing the spacing between the top surface of the block 26 and the bottom surface 30 of the driven element 30.

It is believed that other aspects of the geometry of the block 26 are useful in optimizing the uniformity of the circular polarization. Accordingly, the block 26 is provided with rectangularly shaped surfaces, this configuration having been found to optimize the uniformity of the circular polarization. If desired, the height of the block may be increased, in which case the area of the top surface of the block 26 is to be decreased to maintain the same value of capacitance between the block 26 and the driven element 18.

The invention has achieved, in the case of a single radiating element, an axial ratio of radiation components less than approximately 1.0 dB over a bandwidth of 10.2 percent, and an axial ratio less than approximately 2.0 dB over a bandwidth of twenty-three percent. The overall bandwidth is increased to twenty-seven percent by utilization of an array of antenna elements such as the rotational arrangement of antenna elements shown in FIG. 4.

It is to be understood that the above described embodiments of the invention are illustrative only, and that modifications thereof may occur to those skilled in the art. Accordingly, this invention is not to be regarded as limited to the embodiments disclosed herein, but is to be limited only as defined by the appended claims.

What is claimed is:

1. A patch antenna comprising:

an electrically conductive ground-plane element;

an electrically conductive patch radiator;

means for positioning said radiator in spaced-apart relation to said ground-plane element;

a first feed and a second feed disposed on said ground-plane element and capacitively coupled to said radiator, said first feed and said second feed being offset from a center of said radiator and being arranged in space-quadrature relation relative to said radiator for generation of circularly polarized radiation at said radiator; and a capacitive reactance element disposed on said ground-plane element and capacitively coupled to said radiator, said reactance element being located equally distant from said first and second feeds and being located on a side of said radiator opposite said first and said second feeds, wherein the total reactance of said first and second feeds is larger by approximately one order of magnitude than the reactance produced by said reactance element, in order to reduce mutual coupling between said first and said second feeds and said radiator such as to counteract any elliptical polarization and to thereby ensure production of accurate and uniform circular polarization.

2. An antenna according to claim 1 wherein each of said feeds comprises a post electrically insulated from said ground-plane element and extending from said ground-plane element partway to said radiator, each of said feeds being capacitively coupled to said radiator; and said reactance element is a capacitive reactance element.

3. An antenna according to claim 2 wherein said reactance element comprises electrically-conductive post means extending from said ground-plane element partway to said radiator to introduce capacitive reactance between said ground-plane element and said radiator.

4. An antenna according to claim 3 wherein the post means of said reactance element is configured as a rectangular block.

5. An antenna according to claim 3 wherein said positioning means is an insulating rod extending from said ground-plane element to said radiator.

6. An antenna according to claim 3 wherein said positioning means is an electrically conductive rod extending from said ground-plane element to a center of said radiator, said radiator having a cross-sectional dimension equal to approximately one-half wavelength of radiation emitted by said radiator.

7. An antenna according to claim 3 wherein said positioning means comprises a layer of dielectric material extending from said ground-plane element to said radiator.

8. An antenna according to claim 3 wherein said radiator comprises a driven element and a parasitic element, said driven element and said parasitic element being disc shaped and being parallel to each other, said driven element being located between said parasitic element and said ground-plane element, there being a spacer between said driven element and said parasitic element for maintaining a spaced-apart relationship between said driven element and said parasitic element.

9. A patch antenna comprising:

an array of electrically conductive patch radiators;

a common electrically-conductive ground-plane element, said patch radiators being spaced apart from each other and from said ground-plane element, each of said patch radiators being disc-shaped and disposed parallel to said ground-plane element;

means for positioning said radiators in spaced-apart relation to said ground-plane element;

a plurality of feed assemblies electromagnetically coupled to respective ones of said radiators, each of said feed assemblies comprising a first feed and a second feed disposed on said ground-plane element and capacitively coupled to a respective one of said radiators; and wherein, at each of said radiators, the first feed and the second feed are offset from a center of the radiator and arranged in spaced-quadrature about a center of said radiator for generation of circularly polarized radiation at said radiator; and said antenna further comprises a plurality of capacitive reactance elements disposed on said ground-plane element and electromagnetically coupled to respective ones of said radiators; and wherein, at each of said radiators, each reactance element is located substantially equidistant from the first and the second feeds coupled to said radiator, the reactance element being located on a side of said radiator opposite siad first and said second feeds, and wherein further, the total reactance produced by said first and said second feeds of each of said feed assemblies is larger by approximately one order of magnitude than the reactance produced by said reactance element associated with the corresponding respective one of said radiators, in order to reduce mutual coupling between said first and said second feeds of each said radiator such as to counteract any elliptical polarization and to thereby ensure production of accurate and uniform circular polarization.

10. An antenna according to claim 9 wherein, at each of said radiators, each of said feeds comprises a post electrically insulated from said ground-plane element and extending from said ground-plane element partway to said radiator, each of said feeds being capacitively coupled to said radiator; and said reactance element is a capacitive reactance element.

11. An antenna according to claim 10 wherein, at each of said radiators, said reactance element comprises electrically-conductive post means extending from said ground-plane element partway to said radiator to introduce capacitive reactance between said ground-plane element and said radiator.

* * * * *